US010202822B2

(12) United States Patent
Silva

(10) Patent No.: US 10,202,822 B2
(45) Date of Patent: Feb. 12, 2019

(54) PLUGS INCLUDING INSERT FOR COMPOSITE THREADED MANDREL FOR DOWNHOLE APPLICATIONS

(71) Applicant: Zachary S. Silva, Houston, TX (US)

(72) Inventor: Zachary S. Silva, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 329 days.

(21) Appl. No.: 14/952,316

(22) Filed: Nov. 25, 2015

(65) Prior Publication Data

US 2017/0145776 A1 May 25, 2017

(51) Int. Cl.
*E21B 33/134* (2006.01)

(52) U.S. Cl.
CPC ..... *E21B 33/134* (2013.01)

(58) Field of Classification Search
CPC ..... E21B 23/01; E21B 23/06; E21B 33/129; E21B 33/134; E21B 34/14; E21B 19/10
See application file for complete search history.

(56) References Cited

U.S. PATENT DOCUMENTS 4,093,280 A * 6/1978 Yoshizawa ..... F16L 15/001 285/148.13
4,154,298 A * 5/1979 Gano ..... E21B 23/06 166/243
4,975,014 A * 12/1990 Rufin ..... F16B 35/00 403/30
6,186,558 B1 * 2/2001 Komolrochanaporn ..... F16L 55/00 285/148.19
6,712,153 B2 * 3/2004 Turley ..... E21B 33/1208 166/118
2007/0227745 A1 * 10/2007 Roberts ..... E21B 23/06 166/386
2016/0167319 A1 * 6/2016 Sabo ..... E21B 17/042 156/172

OTHER PUBLICATIONS https://en.oxforddictionaries.com/definition/recess (Year: 2018).*
https://en.oxforddictionaries.com/definition/notch (Year: 2018).*
https://en.oxforddictionaries.com/definition/indent (Year: 2018).*

* cited by examiner

*Primary Examiner* — Brad Harcourt
*Assistant Examiner* — David Carroll
(74) *Attorney, Agent, or Firm* — Cantor Colburn LLP

(57) ABSTRACT

An apparatus for use in a wellbore is disclosed that in one non-limiting embodiment includes a mandrel having a recess on a lower section thereof, a packing element around the mandrel, wherein the packing element provides a seal between the apparatus and the wellbore when the packing element is expanded radially outward from the mandrel; and a threaded member having a threaded outer surface placed around the lower section of the mandrel, and wherein strength of the threaded member is greater than the strength of the lower section of the mandrel. The apparatus may further include a guide member threaded on the threaded member to provide support to the mandrel. The apparatus may be utilized as a frac plug and a bridge plug.

13 Claims, 3 Drawing Sheets

PLUGS INCLUDING INSERT FOR COMPOSITE THREADED MANDREL FOR DOWNHOLE APPLICATIONS

BACKGROUND

1. Field of the Disclosure

The disclosure relates generally to plugs and other devices that utilize composite threaded members subjected to loads during downhole applications.

2. Background Art

Devices such as frac plugs and bridge plugs are commonly utilized in wellbores to perform a variety of downhole operations. Some such plugs include a composite threaded member, such as a composite threaded mandrel, on which another member or device, such as a guide is threaded, to protect the plug during run-in of the plug in the wellbore and from other subsequent downhole conditions or operations. The composite material often is a fiber-based material, such as fiber glass. Often, the shear values of such composite mandrels in some applications are insufficient to provide pitch and wind angles for the threads able to withstand high loads applied on such members during run-in and later wellbore operations. A guide is typically made from a phenolic material with internal threads that mate with the threads on the composite mandrel. In some downhole applications, such threading arrangement is not sufficient to protect the composite member. Therefore, there is a need to provide downhole devices, such as plugs, that include threaded composite members that can withstand higher loads than contained in currently available devices, including, but not limited to, frac plugs and bridge plugs.

The disclosure herein provides downhole devices that include a threaded member placed around a recess on a composite member possessing greater strength than the strength of the composite member, so that the combination of the composite member and the threaded member can absorb greater loads than loads the composite member can absorb during downhole operations at present.

SUMMARY

An apparatus for use in a wellbore is disclosed that in one non-limiting embodiment includes a mandrel having a recess on a lower section thereof, a packing element around the mandrel, wherein the packing element provides a seal between the apparatus and the wellbore when the packing element is expanded radially outward from the mandrel; and a threaded member having a threaded outer surface placed around the lower section of the mandrel, wherein strength of the threaded member is greater than the strength of the lower section of the mandrel. The apparatus may further include a guide member threaded on the threaded member to provide support to the mandrel. The apparatus may be utilized as a frac plug or a bridge plug.

In another aspect, a method of placing a plug in a wellbore is disclosed that in one embodiment includes: conveying the plug by a string into the wellbore and locating the plug at selected location in the wellbore, wherein the plug includes a mandrel having a recess on a lower section of the mandrel, a packing element around the mandrel to provide a seal between the packing element and the wellbore, and a threaded member having a threaded outer surface placed around the lower section of the mandrel, and wherein strength of the threaded member is greater than the strength of the lower section of the mandrel; expanding the packing element radially outward to form the seal between the packing element and the wellbore; and performing an operation in the well bore.

Examples of the more important features of an apparatus and methods have been summarized rather broadly in order that the detailed description thereof that follows may be better understood, and in order that the contributions to the art may be appreciated. There are, of course, additional features that will be described hereinafter and which will form the subject of the claims.

DRAWINGS

For a detailed understanding of the apparatus and methods disclosed herein, reference should be made to the accompanying drawing and the detailed description thereof, wherein like elements are generally given same numerals and wherein.

DETAILED DESCRIPTION

In general, the disclosure provides apparatus or devices for downhole use, such as frac plugs and bridge plugs, that include a threaded insert on a load-bearing composite member, such as a mandrel of the plug, wherein strength (such as yield strength, shear strength, etc.) of the threaded insert is greater than the strength of the composite member. The combination of the composite member and the threaded insert on the composite mandrel can withstand loads greater than the devices that utilize threaded composite members. In the case of plugs, the threaded insert increases the shear area through the composite member and maintains the composite length and continuity of the composite mandrel. Should threads be formed on current composite mandrels for placement of a thereon, as is commonly done, lacking the increased shear area, the mandrel would be detrimentally affected. For ease of explanation and understanding, the concepts of the disclosure herein are described in reference to a non-limiting exemplary plug, although such concepts are equally applicable to other downhole devices. Therefore, the disclosure herein is not intended to be limited to plugs.

Figure 1:
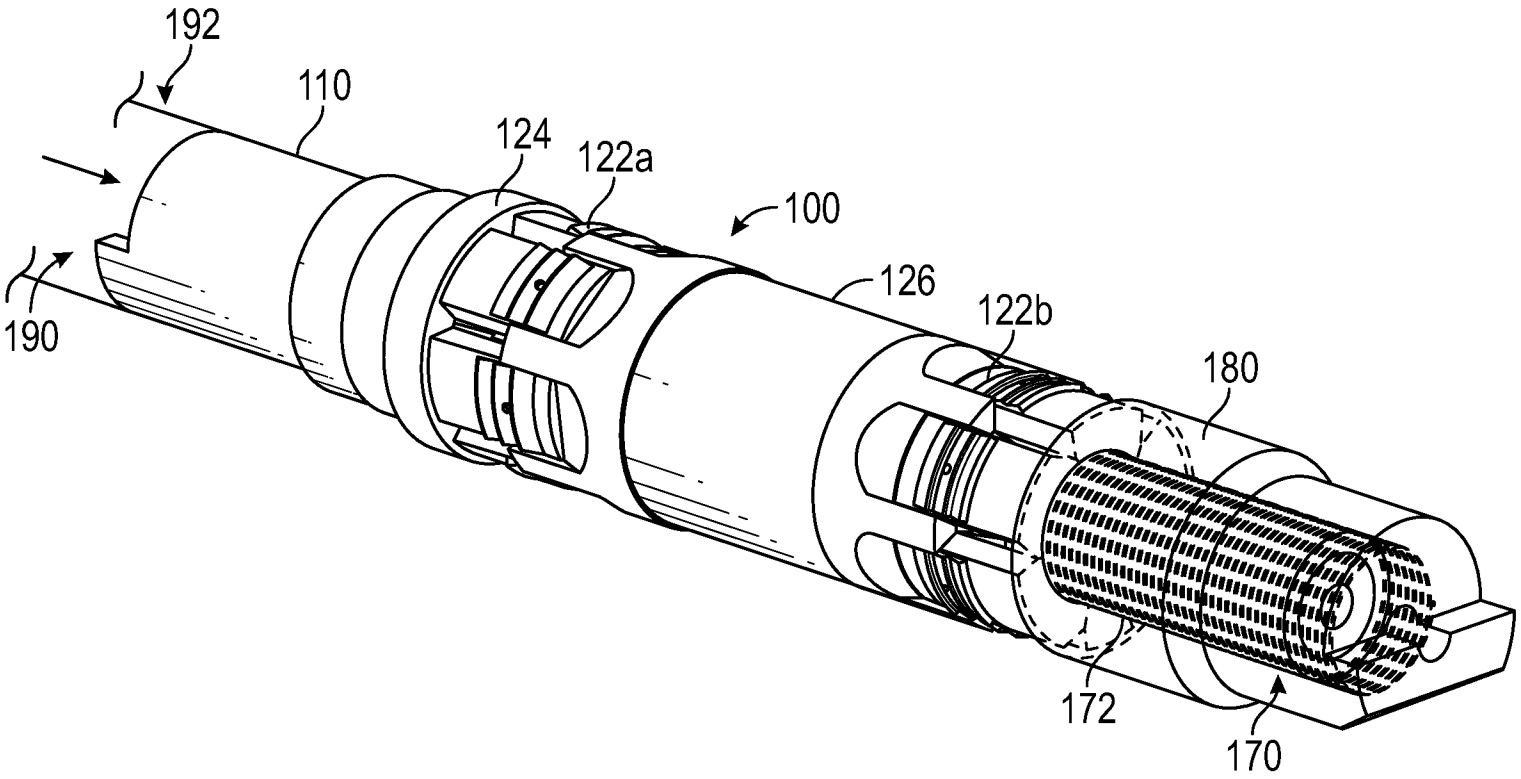
FIG. 1 is a perspective view of a plug for downhole application, according to one embodiment of the disclosure.
Figure 2:
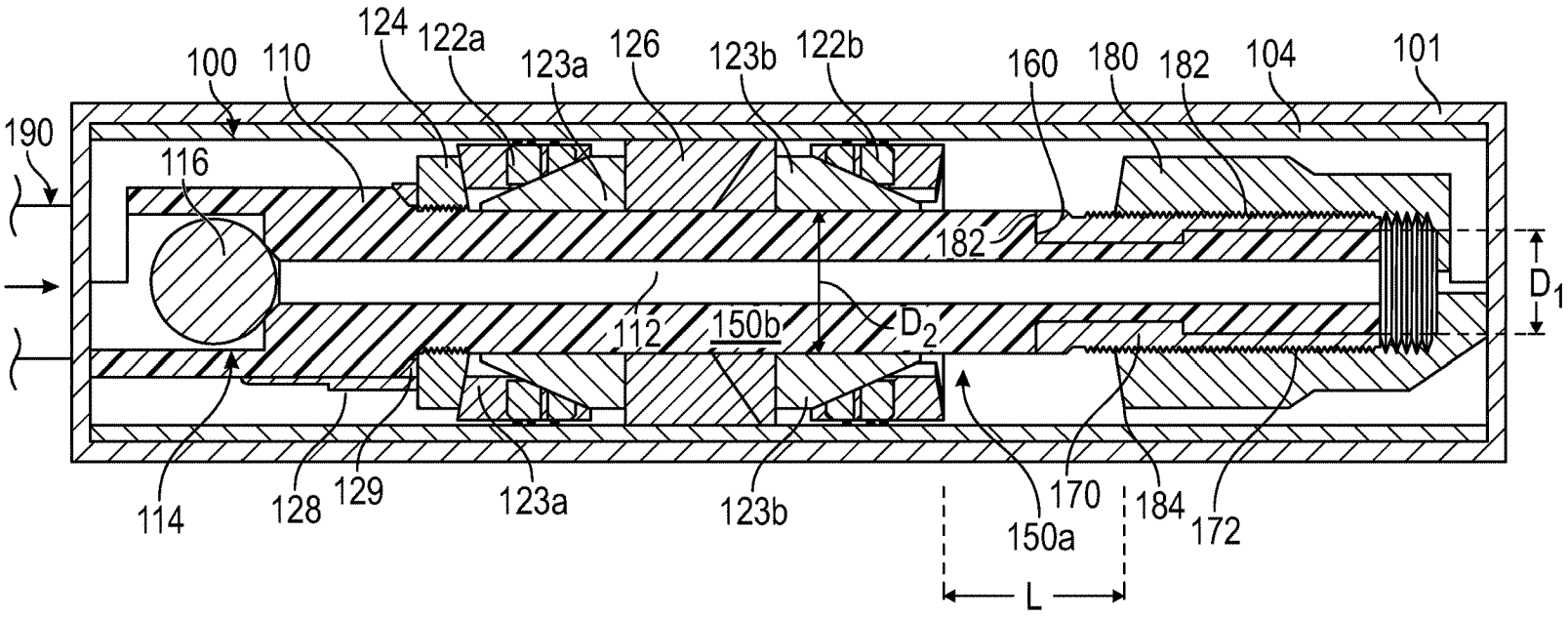
FIG. 2 is a line diagram of the plug of FIG. 1 set and activated in a casing in a well bore.

FIG. 1 is a perspective view of a plug 100 made according to a non-limiting embodiment of the disclosure. FIG. 2 is a line diagram of the plug 100 placed and activated inside a casing 104 placed inside a wellbore 101 by a setting tool 190, which is typically a string with a tubular 192 attached to the plug 100. Various types of setting tools are known in the art and any suitable setting tool may be utilized for the purpose of this disclosure. Referring to FIGS. 1 and 2, the plug 100 in one aspect may be utilized as a frac plug and in another aspect as bridge plug. The plug 100 includes a mandrel 110 that includes a flow through passage 112. The mandrel 110 further includes a seat 114 for landing a ball 116 therein after the plug has been set or deployed in the wellbore. A sealing device 120 (such as a packer) is disposed around the mandrel 110 to set the plug 100 in the casing 104. The sealing device 120 includes an upper slip 122*a* and a lower slip 122*b*. A packing element 126 is placed on around the mandrel 110 between the upper slip 122*a* and the lower slip 122*b*. An upper load ring 124 is provided above the upper slip 122*a* to activate or expend the packing element 126 to engage with the casing 104. A shear member, such as a ring 128, along with a shear washer 129, are provided above the upper slip 122*a*. The shear ring 128 shears off during setting of the plug 100 in the casing 104 and is retrieved from the wellbore 101 when the setting tool 190 is retrieved from the wellbore 101. In one non-limiting embodiment, the mandrel 110 is made from a composite material, which may be a fibrous material, including, but not limited to, fiber glass. A lower section or portion 150*a* of the mandrel 110 has a diameter $D_1$ smaller than the diameter $D_2$ of the upper section 150*b*. The lower section 150*a* further includes one or more recesses or notches, such as notch 160. A threaded member 170, having outer threads 172 and an indented section 174, is placed around the lower section 150*a* of the mandrel 110. The indented section 174 mates with or conforms to or substantially conforms to the recess 160. Thus, the indented section 174 of the threaded member 170 seats inside the recess 160 and the threads 172 are exposed to the environment. A suitable guide 180 may be threaded onto the threads 172 of the member 170. In one aspect, the material of the threaded member 170 has a yield strength greater than the yield strength of the material of at least the lower section 150*a* of the mandrel 110. In another aspect, the material of the threaded member 170 has hardness greater than the hardness of the material of at least the lower section 150*a* of the mandrel 110. Also, in aspects, the material of the threaded member 170 is at least as strong as the material of the guide 180. Thus, the higher strength material of threaded member 170 allows the use of a higher strength guide 180 compared to a mandrel with threads thereon for mating with the guide 180. The member 170 is an insert that may be configured in any suitable shape for placement around the lower section 150*a* of the mandrel 110. In one embodiment, the member 170 may be in the form of a clam shell that can be placed around the mandrel lower section 150*a*. The insert 170 may include more than two axial members, each configured to be placed around the lower section 150*a* of the mandrel in a manner that will enable a device, such as guide 180 having internal threads, to mate with the thread 172 on the member 170. The member 170 may be made from any suitable material, including, but not limited to, phenolic, a metal or alloy, including, but not limited to, aluminum and cast iron.

In the embodiments described above, the insert member 170 on an otherwise composite mandrel acts to increase the shear area through the mandrel and also maintains fiber length continuity of a fibrous material mandrel that would otherwise be detrimentally affected by cutting threads through the composite material. The insert 170 acts as a threaded interface between the mandrel and a threaded mating component, such as guide 180, for downhole composite devices applications. For example, for a composite frac plug that includes a filament wound mandrel and a phenolic lower guide, the phenolic guide may shear the filament threads. Filament-wound threads suffer in this regard because they must be machined after the mandrel has been wound, which in effect reduces the strength that the wind angles produce, because those continuous fibers are cut in order to form the thread.

The recess 160 is provided in the outer diameter of the mandrel 110 at a distance from the end 110*a* that will satisfy a desired shear area. A clamshell of material that is at least as strong as the box mating component is then fit into this recess 160, and have threads that extend to the end 110*a*. The mating guide 180 can then be threaded onto the threaded member (clamshell or another configuration). All tensile loads between the mandrel 110 and the lower guide 180 goes from the lower guide thread 181 to the clamshell thread 172, which is equal to or greater than the strength of the lower guide threads 181, and then transmitted to the increased shear plane of the mandrel. The edges 182*a* and 182*b* of the recess 180 do need not be perpendicular to axis, and the threads 172 may be of any form or pitch. Member 170 may be made from multiple composites or a collet type construction, material does not have to be limited to molded phenolic or filament-wound fiber for the above mentioned description.

Still referring to FIGS. 1 and 2, to set the plug 100 at a desired location, the string 190 with the plug 100 attached to a bottom end of a tubular 192 is conveyed into the wellbore 101. Fluid 103 under pressure is applied to the setting tool 190, which causes the slips 122*a* and 122*b* move over their respective cones 123*a* and 123*b*, pushing the packing element 126 radially outward, until the packing element 126 is forced against inside of the casing 104 in the wellbore 101, as shown in FIG. 2. The upper load ring 129 prevents the slip 122*a* from moving upward or uphole. Setting of the packing element 126 against the casing 104 creates a spacing "L" between the bottom of the slip 122*b* and the upper end 184 of the guide 180, as shown in FIG. 2.

Figure 3:
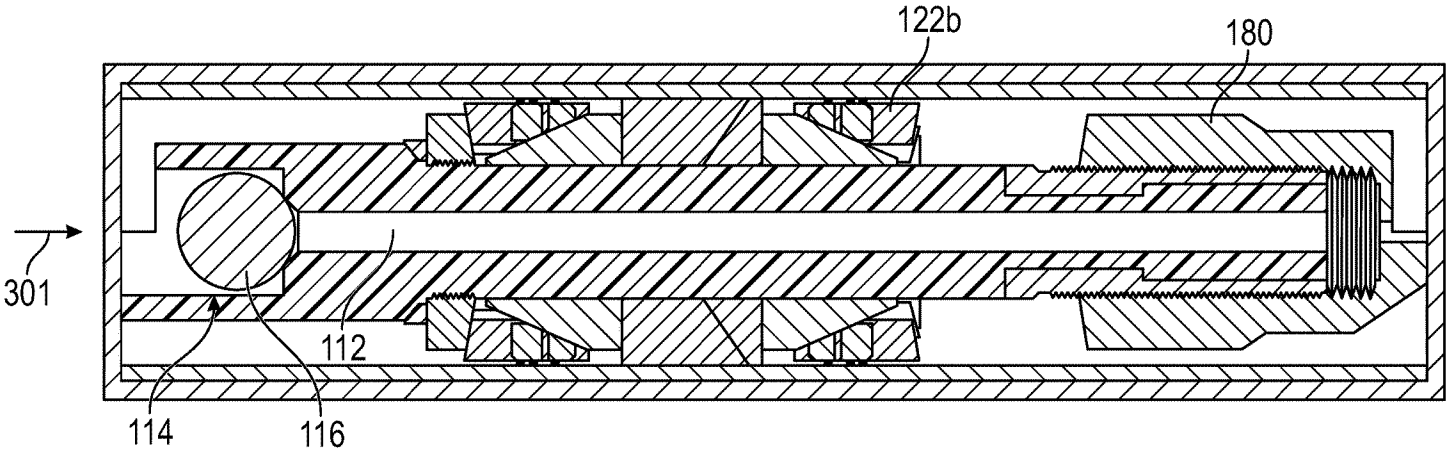
FIG. 3 is the plug of FIG. 2 set or activated in a casing in the wellbore when used as a frac plug.
Figure 4:
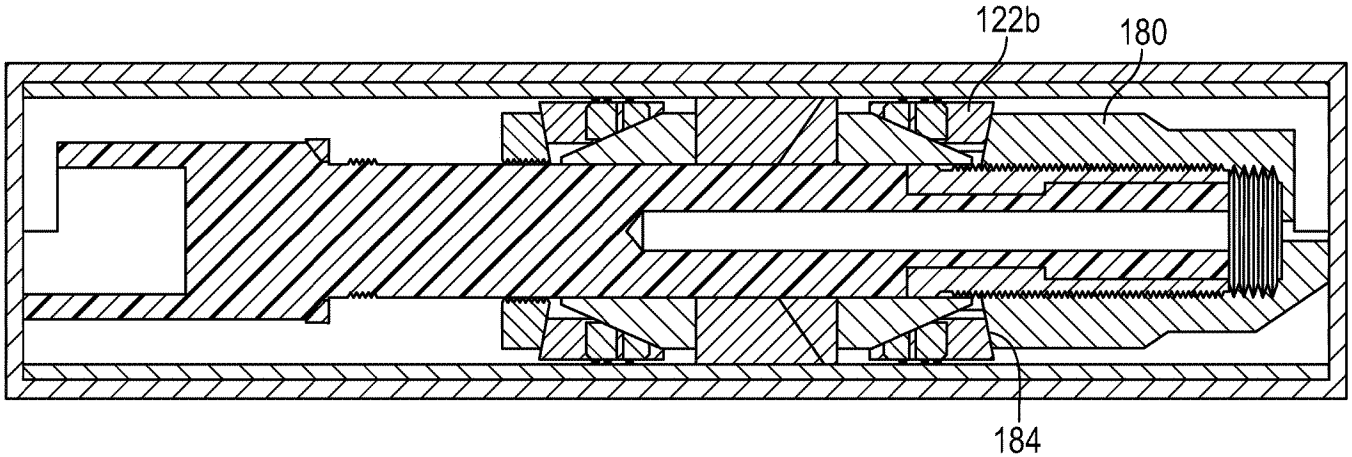
FIG. 4 is the plug of FIG. 2 set or activated in a casing in the wellbore when used as a bridge plug.

The use of the plug 100 as a frac plug is shown in FIG. 3, while the use of the plug 100 as a bridge plug is shown in FIG. 4. For frac plug applications, a ball 116 is dropped from the surface after the plug 100 has been set in the wellbore, which ball seats or lodges in the seat 114 and blocks flow of fluid 301 supplied from the surface through the passage 112 in the mandrel 110. This allows a desired fluid, such as fracing fluid, to be supplied to a desired location in the formation above the ball 116. To use the plug 100 as a bridge plug, the passage 112 is removed from the mandrel, as shown in FIG. 4, and when pressure is applied downhole of the packing element 126, the guide 160 moves upward until its upper end 184 of the guide 180 comes in contact with the slip 122*b*.

The foregoing disclosure is directed to the certain exemplary non-limiting embodiments. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. An apparatus for use in a wellbore, comprising:

a mandrel having a lower section thereof, the lower section having a recess at a selected distance from an end of the lower section;

a packing element around the mandrel that provides a seal between the packing element and the wellbore when the packing element is set; and a threaded member including one of a clam shell and a collet, the threaded member adapted to be placed around the lower section of the mandrel, the threaded member having a section having a reduced inner diameter that seats inside the recess and having a threaded outer surface, wherein a yield strength of the threaded member is greater than a yield strength of the lower section of the mandrel.

2. The apparatus of claim 1, wherein at least one edge of the recess is one of: a vertical edge; a curved edge; and an angled edge.

3. The apparatus of claim 1 further comprising a guide member threaded onto the threaded member to provide support to the mandrel.

4. The apparatus of claim 1, wherein the lower section of the mandrel is made from a composite material.

5. The apparatus of claim 1, wherein the threaded member is made from a material selected from a group consisting of: aluminum; cast iron; phenolic; and multiple phenolics.

6. A method of placing a plug in a wellbore, the method comprising:

conveying the plug by a string into the wellbore and locating the plug at a selected location in the wellbore, the plug including a mandrel having a recess on a lower section of the mandrel, a packing element around the mandrel, wherein the packing element provides a seal between the packing element and the wellbore, and a threaded member being a clam shell shaped member adapted to be placed around the lower section of the mandrel, the threaded member having a section having a reduced inner diameter that seats inside the recess and having a threaded outer surface, and wherein a yield strength of the threaded member is greater than a yield strength of the lower section of the mandrel;

setting the packing element to form the seal between the packing element and the wellbore; and performing an operation in the wellbore.

7. The method of claim 6, wherein the lower section of the mandrel is made from a composite material.

8. The method of claim 6, wherein the threaded member is made from a material selected from a group consisting of: aluminum; cast iron; phenolic; and multiple phenolics.

9. The method of claim 6, wherein the plug further includes a guide member threaded onto the threaded member to protect the threaded member during downhole operations.

10. The method of claim 6, wherein at least one edge of the recess is one of: a vertical edge; and an angled edge.

11. A wellbore system, comprising:

a plug placed at a selected location in a casing in the wellbore, wherein the plug includes:

a packing element around a mandrel that provides a seal between the packing element and the casing when the packing element is set; and a threaded member being a clam shell shaped member adapted to be placed around a lower section of the mandrel, the threaded member having a section having a reduced inner diameter that seats inside a recess in the lower section of the mandrel, the threaded member having a threaded outer surface, wherein a yield strength of the threaded member is greater than a yield strength of the lower section of the mandrel.

12. The wellbore system of claim 11, wherein at least one edge of the recess is one of: a vertical edge; a curved edge; and an angled edge.

13. The wellbore system of claim 11 further comprising a guide member threaded onto the threaded member to provide support to the mandrel, wherein the yield strength of the threaded member is same or greater than the yield strength of the guide.

* * * * *